United States Patent [19]

Marianowski et al.

[11] Patent Number: 4,908,113

[45] **Date of Patent: * Mar. 13, 1990**

[54] APPARATUS FOR THE ELECTROCHEMICAL SEPARATION OF OXYGEN

[75] Inventors: Leonard G. Marianowski, South Holland; Robert J. Remick, Bolingbrook, both of Ill.

[73] Assignee: Institute of Gas Technology, Chicago, Ill.

[ * ] Notice: The portion of the term of this patent subsequent to Apr. 19, 2005 has been disclaimed.

[21] Appl. No.: 364,863

[22] Filed: Jun. 12, 1989

Related U.S. Application Data

[60] Division of Ser. No. 160,242, Feb. 25, 1988, Pat. No. 4,859,296, which is a continuation-in-part of Ser. No. 91,716, Sep. 1, 1987, Pat. No. 4,738,760.

[51] Int. Cl.[4] ..... C25B 1/02

[52] U.S. Cl. ..... 204/243 R; 204/245; 204/246; 204/247; 204/60; 204/61; 204/63; 204/12.9; 204/130

[58] Field of Search ..... 204/60, 61, 63, 129, 204/130, 246, 247, 243 R, 245

[56] References Cited

U.S. PATENT DOCUMENTS

| | | | |
|---|---|---|---|
| 517,001 | 3/1894 | Darling | 204/63 |
| 1,120,436 | 12/1914 | Bergfeld | 423/579 |
| 3,410,783 | 11/1968 | Tomter | 204/266 |
| 3,888,749 | 6/1975 | Chang | 204/129 |
| 4,061,554 | 12/1977 | Duchetel et al. | 204/129 |
| 4,089,938 | 5/1978 | Turner | 423/579 |
| 4,132,766 | 1/1979 | Erickson | 423/579 |
| 4,287,170 | 9/1981 | Erickson | 423/579 |
| 4,300,987 | 11/1981 | Tseung et al. | 204/129 |
| 4,340,578 | 7/1982 | Erickson | 423/579 |
| 4,475,994 | 10/1984 | Cagne et al. | 204/129 |
| 4,526,775 | 7/1985 | Cassano | 423/579 |
| 4,529,577 | 7/1985 | Chen et al. | 423/351 |
| 4,565,685 | 1/1986 | Cassano | 423/579 |
| 4,738,760 | 4/1988 | Marianowski et al. | 204/130 |

FOREIGN PATENT DOCUMENTS 98157 1/1984 European Pat. Off. .

*Primary Examiner*—John F. Niebling
*Assistant Examiner*—David G. Ryser
*Attorney, Agent, or Firm*—Thomas W. Speckman

[57] ABSTRACT

An electrochemical separation of oxygen from oxygen containing gaseous mixtures, such as air, using an oxygen containing molten inorganic salt electrolyte retained in a porous matrix between two gas porous catalytic electrodes wherein oxygen is separated from the gaseous mixture when electrical potential is applied across the electrodes providing movement of non-metallic oxygen containing ion from the cathode to the anode.

7 Claims, 1 Drawing Sheet

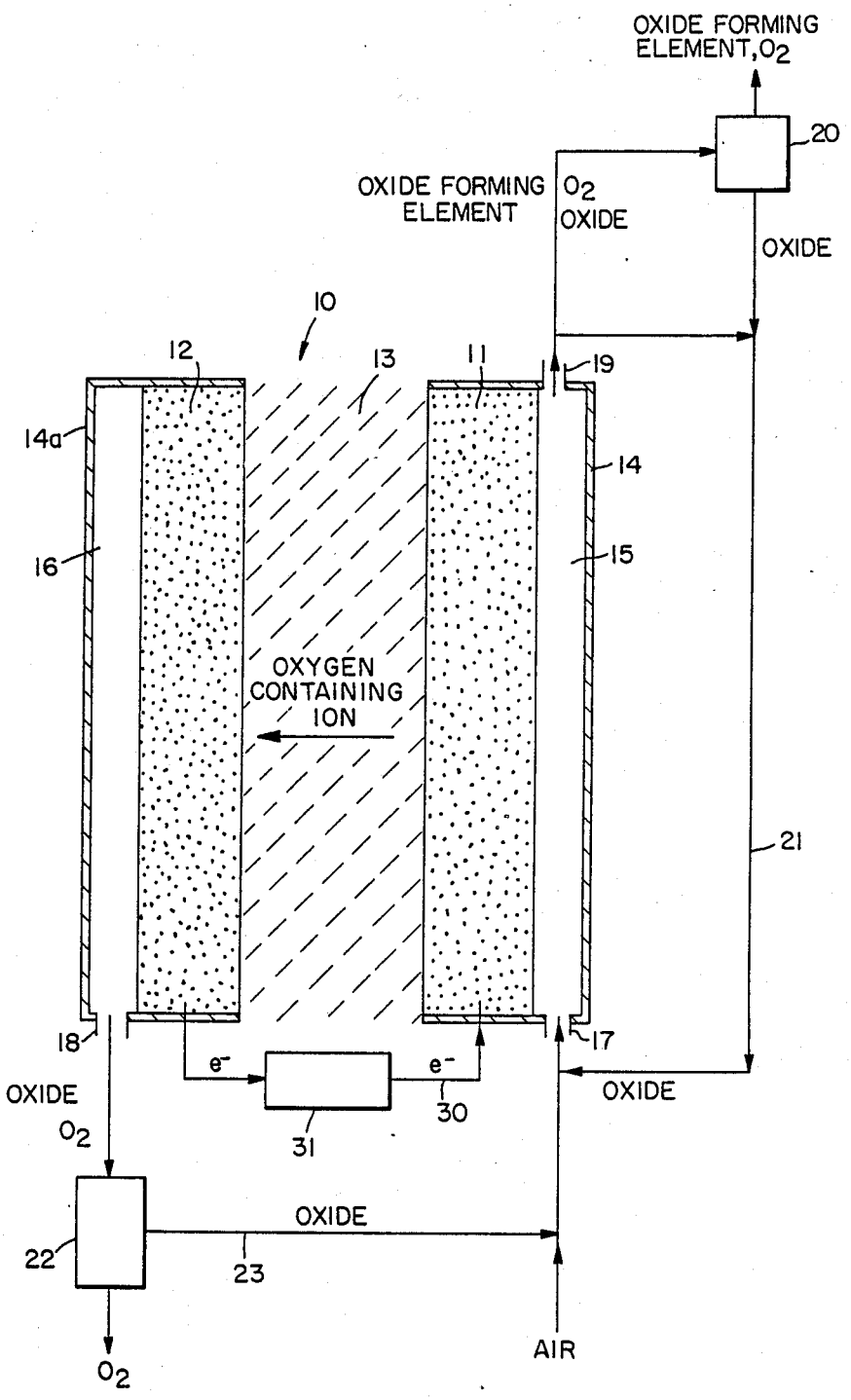
OXIDE FORMING ELEMENT, $O_2$
20
OXIDE FORMING ELEMENT
$O_2$
OXIDE
OXIDE
10
12
13
11
19
14a
14
16
15
OXYGEN CONTAINING ION
21
18
17
e⁻
e⁻
OXIDE
$O_2$
31
30
OXIDE
22
OXIDE
23
$O_2$
AIR

APPARATUS FOR THE ELECTROCHEMICAL SEPARATION OF OXYGEN

CROSS-REFERENCE TO RELATED APPLICATIONS

This application is a divisional application of Ser. No. 07/160,242, filed Feb. 25, 1988, now U.S. Pat. No. 4,859,296, filed as a continuation-in-part of Ser. No. 07/091,716, filed Sep. 1, 1987, now U.S. Pat. No. 4,738,760.

BACKGROUND OF THE INVENTION

1. Field of the Invention

The present invention relates to a process for electrochemical separation of oxygen from oxygen containing gaseous mixtures, such as air, utilizing an oxygen containing molten inorganic salt electrolyte retained in a matrix between two electrodes, wherein oxygen is separated from the gaseous mixture when electrical potential is applied across the electrodes.

2. Description of the Prior Art

Relatively pure oxygen gas has many industrial and medical uses. One process to produce oxygen is electrolysis of water. Electrolysis consumes large amounts of electrical energy and has the further disadvantage of the co-production of hydrogen which presents safety and purity problems.

One widely used oxygen separation process involves cryogenic liquefaction and distillation of air. Cryogenic distillation processes are generally energy intensive and operate at overall efficiencies of less than about 35–40 percent. Cryogenic distillation is generally not economically feasible unless it is operated in very large scale plants, and large scale production results in additional freight costs from a centralized production facility to the end user.

Chemical oxygen separation processes have been developed, such as the Moltox chemical air separation process marketed by Air Products and Chemicals, Inc. This chemical air separation technology claims to achieve reduced energy consumption and therefore increased efficiency, as compared to cyrogenic processes. The basic Moltox chemical air separation process and improvements thereto are described in the following U.S. patents: U.S. Pat. No. 4,132,766 teaches separation of oxygen from air by a regenerative chemical process wherein air is contacted with a molten alkali nitrite and nitrate salt solution oxygen acceptor at elevated temperatures and pressures, causing oxygen to react with nitrites, thereby forming additional nitrates in the molten salt solution. The oxidized molten salt is separated from the oxygen depleted air, and its pressure is reduced while its temperature is increased, causing the release of oxygen. The regenerated oxygen acceptor may then be recycled and the air separation process may be operated in a continuous mode. Separate reactors are required for the absorption and desorption stages, since they are carried out at different temperatures and pressures, requiring pumping of the molten salt oxygen acceptor between the reactors. Corrosion is a serious problem, particularly at the required process temperatures of about 530° to 930°. U.S. Pat. No. 4,340,578 teaches an improvement of the chemical air separation process of the '766 patent, wherein oxygen absorption is conducted in multiple countercurrent stages. Isothermal and adiabatic compression is combined to reduce the compression energy requirement, and the exhaust is processed in a combustion, partial expansion, heat exchange, and completion of expansion sequence to increase the recovery of compression energy. U.S. Pat. No. 4,287,170 teaches another improvement of the chemical air separation process involving production of oxygen and nitrogen by air separation using an oxygen acceptor such as molten alakali nitrite solution, SrO, or Pr-Ce oxides, with the remaining oxygen being removed by reaction with a scavenger such as MnO to produce an oxygen-free nitrogen-argon mixture. The oxygen acceptor and oxygen scavenger are regenerated and recycled. U.S Pat. No. 4,526,775 teaches another improvement of the chemical air separation process wherein multiple absorption-desorption cycles are utilized to reduce power requirements and capital costs and increase high pressure oxygen recovery. U.S. Pat. No. 4,529,577 teaches a further improvement to the chemical air separation process wherein a molten salt anion composition includes combined peroxides, oxides and superoxides present in less than about 1 mole percent based upon sodium peroxide, to reduce the corrosiveness of the molten salt solution. U.S. Pat. No. 4,565,685 teaches a further improvement of the chemical air separation process wherein a temperature swing absorption-desorption cycle is used in combination with a pressure swing wherein the pressure is elevated in the desorption stage to provide more efficient generation of high pressure oxygen.

Other chemical processes for separating oxygen from air include those taught by U.S. Pat. No. 1,120,436 which teaches a chemical separation process wherein air reacts with a lower oxide of nitrogen, such as nitrous anhydride ($N_2O_3$) to form a higher oxide of nitrogen, such as nitric acid which, upon heating, decomposes to release oxygen and a lower oxide. Sulfuric acid is used as an intermediary to aid in the oxygen separation; U.S. Pat. No. 4,089,938 teaches an oxygen separation process wherein air is contacted with a suspension of manganese dioxidein an aqueous solution of sodium or potassium hydroxide in a lower pressure absorbing zone, and the resulting liquid, oxygen enriched, stream is then pumped to a high pressure generating zone and contacted with steam to release the absorbed oxygen; and European Patent 98,157 teaches a solvent absorption system for separation of oxygen utilizing temperature and/or pressure swings to maintain the necessary oxygen pressures during absorption and desorption.

Separation of oxygen from a mixture of gases such as air by electrochemical means has also been proposed. East German Patent 119,772 teaches recovery of oxygen enriched air using high temperature electrolytic cells having solid zirconium oxide electrolyte operated at 1200°. The solid electrolyte is provided with porous layers of $LnCoO_3$ (Ln=rare earth) on both the anode and cathode sides. U.S. Pat. No. 4,061,554 discloses chemical oxidation of air to form a peroxide which is electrochemically oxidized to evolve oxygen and regenerate a reduced form which is recycled to the chemical oxidation reactor. U.S. Pat. No. 4,300,987 teaches production of oxygen from air in an aqueous alkaline electrolyte wherein formed peroxide is catalytically decomposed. U.S. Pat. No. 3,410,783 teaches separation of oxygen from air using an electrochemical cell with an aqueous electrolyte which is transported to a separator maintained under a pressure differential relative to the gaseous cell input for oxygen separation. U.S. Pat. No. 3,888,749 teaches electrolytic separation of oxygen from air without application of an external current by having two cells with an aqueous electrolyte circulated between them, the first cell having a high oxygen partial pressure and the second cell having a low oxygen partial pressure producing an emf between the cells and liberating oxygen from the electrolyte in the low oxygen pressure cell. U.S. Pat. No. 4,475,994 teaches an electrochemical process for separating oxygen from a mixture of gases wherein oxygen is reduced to the superoxide ion $O_2^-$ at the cathode, transported by the electrolyte to the anode, and is there reoxidized to oxygen and collected. Aqueous electrolytes at high pH, non-aqueous electrolytes, and solid polymer electrolytes may be used in the practice of the '994 invention. Nitriles, Lewis acids, organic cations, macromolecules such as crowns and cryptands and/or ligands may be added to stabilize the superoxide ion in an aqueous electrolyte.

SUMMARY OF THE INVENTION

It is an object of the present invention to provide an electrochemical process for separating oxygen from oxygen containing gaseous mixtures, such as air, in an oxygen containing molten inorganic salt electrolyte electrochemical cell.

It is an object of the present invention to provide an electrochemical process for separating oxygen from oxygen containing gaseous mixtures, such as air, in a molten alkali metal nitrate, carbonate, sulfate, or phosphate electrolyte electrochemical cell.

It is another object of the present invention to provide an electrochemical process for separating oxygen from oxygen containing gaseous mixtures utilizing an oxygen containing molten alkali inorganic salt electrolyte which achieves high process efficiencies.

It is yet another object of this invention to provide a process for separation of oxygen from air using an oxygen containing molten inorganic salt electrochemical cell which does not require molten salt transfer and which operates at lower temperatures than prior chemical absorption-desorption oxygen separation processes.

According to the present invention, oxygen containing molten inorganic salt electrolyte is retained in a porous matrix between two electrodes. Preferred oxygen containing portions of the salts are nitrates, carbonates, sulfates, and phosphates. It is preferred to use alkali metal salts of potassium, sodium, lithium, and mixtures thereof. These salts have generally low melting points, generally below about 400° C. Suitable electrolyte matrices include MgO, $Al_2O_3$, $LiAlO_2$ and mixtures thereof. The matrix structure is preferably greater than 40 percent porous to hold electrolyte. Under operating conditions, the active electrolyte is molten and is retained by capillarity in the fine porous matrix structure. The electrolytes used in this invention are paste electrolytes analogous to the electrolytes as described in U.S. Pat. No. 4,079,171 with respect to molten carbonate fuel cells. The electrodes are porous electrodes maintained in contact with electrolyte on one side and a gas chamber on the other side. Suitable catalytic electrode materials comprise a catalyst selected from elements of the Periodic Table appearing in a group selected from the group consisting of Groups Ib, IIB, IIIA, VB, VIB, VIIB and VIII. Suitable form for the catalyst include metal, oxide, or cermet form. Preferred catalysts are selected from the group consisting of zinc, silver, nickel, aluminum, iron, copper, chromium, and mixtures thereof. A particularly preferred catalyst is copper oxide. The cathode and anode may be the same or different materials. It is desired that the electrodes provide high porosity and catalytic surface area for the gas-liquid-solid phase electrochemical reaction system. The electrochemical reaction system of this process is driven by an electric potential applied across the two electrodes.

The process of this invention is conducted by providing an oxygen containing gaseous mixture, such as air, to a cathode chamber in an admixture with a suitable oxide for conduct of the electrochemical reaction, such as $NO_2$, $CO_2$, $SO_2$, and $P_2O_5$. In the reducing environment at the cathode, $O_2$ and the oxide react to form an oxygen containing ion according to Equation I:

$$ze^- + nO_2 + XO_m \rightarrow XO_{zn+m}^{z-}$$

Oxygen containing ion is transported across the oxygen containing molten inorganic salt electrolyte to the anode, where the oxygen containing ion is oxidized to produce oxygen according to the Equation II:

$$XO_{zn+m}^{z-} \rightarrow ze^- + nO_2 + XO_m$$

wherein $z = 1, 2, \text{ or } 3;$ $n = \frac{1}{2} \text{ or } 1;$ $m = 1, 2, \text{ or } 3;$ and X = a non-metallic oxide forming element capable of forming the oxide and oxygen containing ion for conduct of the above electrochemical reactions, such as N, C, S, and P.

Effluent gases are withdrawn from the anode and oxygen is separated from the oxide in a separator, such as a condenser, to yield oxygen gas having a high purity level. Oxide recovered at the final stage of oxygen separation is preferably recycled to the cathode. Effluent gases are withdrawn from the cathode and condensed with the non-metallic oxide forming element and unused $O_2$ being discharged to prevent their buildup in the process cycle. The process of this invention may be carried out at temperatures of about 500° to about 900° C., preferably about 500° to about 700° C. The process of this invention may be, in many instances, carried out at temperatures below those required by prior chemical absorption processes involving thermal regeneration of the sorbent, thereby using less energy. Likewise, the process of this invention may be carried out at pressures of about 1 to about 100 atmospheres, preferably about 1 to about 5, not requiring compression energy of prior processes dependent upon pressure differentials for operation and oxygen release.

In a preferred embodiment, the process of this invention is conducted by providing an oxygen containing gaseous mixture, such as air, to a cathode chamber in an admixture with $NO_2$. In the reducing environment at the cathode, $O_2$ and $NO_2$ react according to Equation III:

$$NO_2 + \frac{1}{2}O_2 + e^- \rightarrow NO_3^-$$

Ionic $NO_3^-$ is transported across the molten alkali metal nitrate electrolyte to the anode, where ionic $NO_3^-$ is oxidized according to the Equation IV.

$$NO_3^- \rightarrow NO_2 + \frac{1}{2}O_2 + e^-$$

Effluent gases are withdrawn from the anode and oxygen is separated from $NO_2$ in a separator, such as a condenser, to yield oxygen gas having a high purity level. $NO_2$ recovered at the final stage of oxygen separation is preferably recycled to the cathode. Effluent gases are withdrawn from the cathode and condensed with $N_2$ and unused $O_2$ being discharged to prevent its buildup in the process cycle. The process of this preferred embodiment may be carried out at temperatures of about 500° to about 700° C., preferably about 500° to about 600° C.

BRIEF DESCRIPTION OF THE DRAWING

These and other features, aspects and advantages of the present invention will be more fully understood when considered with respect to the following detailed description of preferred embodiments and the accompanying drawing which is a highly schematic representation of an electrochemical cell for separating oxygen from air in accordance with the present invention.

DESCRIPTION OF PREFERRED EMBODIMENTS

Although the process of the present invention is described below with reference to the schematic electrochemical cell 10 shown in the drawing, it should be understood that the components of the electrochemical cell 10 utilized in the practice of the present invention may be provided in various configurations which are well known to the art of electrochemical cell design.

As shown in the figure, electrochemical cell 10 comprises gas porous cathode 11 and gas porous anode 12 in contact with oxygen containing molten inorganic salt electrolyte 13. Housing 14 encloses cathode chamber 15 and housing 14a encloses anode chamber 16 for confining reactant and product gases. External electrical circuit 30 is in electrical contact with cathode 11 and anode 12 for electron transport and has power supply means 31 to provide electrical potential across the electrodes to drive the electrochemical reactions.

Suitable gas porous cathodes and anodes for use in this invention are catalytic electrodes and comprise a catalyst selected from elements of the Period Table appearing in a group selected from the group consisting of Groups IB, IIB, IIIA, VB, VIB, VIIB and VIII. Suitable forms for the catalyst include metal, oxide, or cermet form. Preferred catalysts are selected from the group consisting of zinc, silver, nickel, aluminum, iron, copper, chromium, and mixtures thereof. A particularly preferred catalyst is copper oxide. Porous catalytic electrodes suitable for use in this invention may be produced by conventional sintering techniques.

Suitable electrolytes comprise an oxygen containing ion conducting oxygen containing molten inorganic salt electrolyte. Preferred oxygen containing non-metallic portions of the salts are nitrates, carbonates, sulfates, and phosphates and it is preferred to use alkali metal salts of potassium, sodium, lithium, and mixtures thereof. One preferred electrolyte comprises molten alkali nitrate in a porous matrix, such as disclosed in U.S. Pat. No. 4,079,171. The electrolytes may be produced in the same manner as disclosed in the U.S. Pat. No. 4,079,171 and filled with a molten alkali nitrate. Preferred alkali metal nitrates are potassium nitrate, sodium nitrate, lithium nitrate, and mixtures thereof.

An oxygen containing gas, such as air, is admixed with an appropriate oxide, such as corresponding $NO_2$, $CO_2$, $SO_2$ and $P_2O_5$ are introduced into cathode chamber 15 through cathode chamber input means 17. The air-oxide, such as air-$NO_2$, admixture suitably has a 1 to about 30 mole percent oxide concentration, and preferably about 15 to about 20 mole percent oxide. These mole percent concentrations are suitable when the $O_2$ concentration is about the same as in air, however, must be adjusted for higher or lower oxygen concentrations. Any oxygen containing gas may be used which does not contain components which enter into significant interfering or competing reactions in the cathode environment. At the three phase interface, reactant gas-liquid electrolyte-solid catalytic cathode, the reaction of Equation I takes place and the oxygen containing ion, such as $NO_3$, is transported through the oxygen containing molten inorganic salt, such as alkali metal nitrate, electrolyte 13 to anode 12 in a manner analogous to the transport of the carbonate ion through the molten alkali metal carbonate electrolyte in a molten carbonate fuel cell. Exhaust gas is withdrawn from cathode chamber 15 through withdrawal means 19 and may be passed through a separator, such as condenser 20, for separation and discharge of the non-metallic oxide forming element and unused oxygen to prevent their buildup in the process. Exhaust gases containing principally oxide, such as $NO_2$, may be recycled by recycle means 21 to input means 17.

Oxygen containing non-metallic ions, such as ionic $NO_3^-$, pass in the direction indicated by the arrow through oxygen containing molten inorganic salt electrolyte 13 to anode 12. At the catalytic surface of anode 12, the reaction of Equation II takes place and gaseous $O_2$ and oxide are removed from anode chamber 16 through product gas output means 18 to separator means 22, such as a condenser for condensation of oxide, such as $NO_2$, for recycle to cathode chamber input means 17. Electrons released in the anode reaction are passed through external electrical circuit 30 to cathode 11. Power supply means 31 in external electrical circuit 30 supplies the emf to drive the desired electrochemical reaction. The drawing is in simplified schematic form and it will be understood by one skilled in the art that desired valves, pumps, blowers, and control systems known to the art will be used to obtain the desired process results.

The electrochemical cell according to this invention operates at about 500° to about 900° C., preferably about 500° to about 700° C., dependent upon the inorganic oxygen containing salt melting point, and pressures between about 1 atmosphere and about 100 atmospheres, preferably about 1 to about 5 atmospheres.

The energy (W) required for operation of a concentration cell according to this invention includes the work required to overcome the electromotive force (emf) of the cell ($W_{REV}$), and the ohmic resistance and over potential losses ($W_{IRR}$), or $$W = W_{REV} + W_{IRR} \qquad \text{Equation III}$$

wherein for the transfer of 1 mole of oxygen:

$$W_{REV} = \frac{RT}{ZF} \ln \underbrace{\left[ \left( \frac{P_{O_2}^{an}}{P_{O_2}^{cath}} \right)^n \left( \frac{P_{XOm}^{an}}{P_{XOm}^{cath}} \right) \right]}_{\text{emf of concentration cell}} \qquad \text{Equation IV}$$

-continued $$\underbrace{\frac{z}{n}F}_{\text{Charge required to transfer 1 mole of oxygen}}$$

Equation V $$\underbrace{W_{IRR} = \frac{z}{n}F}_{\text{charge required to transfer 1 mole of oxygen}} \cdot \underbrace{\Delta V}_{\text{ohmic and overpotential loss}}$$

and

Equation VI $$W = \frac{RT}{n}\ln\left[\left(\frac{P_{O_2}^{an}}{P_{O_2}^{cath}}\right)^n\left(\frac{P_{XOm}^{an}}{P_{XOm}^{cath}}\right)\right] + \frac{z}{n}F\Delta V$$

wherein z, n, m, and X have the same meaning as for Equations I and II.

Assuming $P_{O_2}^{an}=0.33$ atm; $P_{O_2}^{cath}=0.20$ atm; $P_{XOm}^{an}=P_{XOm}^{cath}$; $\Delta V=300$ mV; and $T=923°$ K., the energy required to transfer 1 mole of $O_2$ becomes $$W=z/nF\,(emf+\Delta V)$$ Equation VII.

Accordingly:

$$W(CO_3^{=})=1.36\,F,\ W.s/mol\ O_2$$

$$W(NO_3^{-})=0.72\,F,\ W.s/mol\ O_2$$

$$W(SO_4^{=})=0.72\,F,\ W.s/mol\ O_2$$

A table may be constructed showing the energy required to transfer 1 mole of $O_2$ given these conditions:

TABLE 1

| Conduct. Ion | W kWh/mol $O_2$ | kWh/ton $O_2$ | kWh/1000 $ft^3$ $O_2$ | n | z |
|---|---|---|---|---|---|
| $CO_3$ | 0.0365 | 1215 | 43.9 | ½ | 2 |
| $NO_3$ | 0.0193 | 643 | 23.2 | ½ | 1 |
| $SO_4$ | 0.0193 | 643 | 23.2 | 1 | 2 |

From Table 1 it is seen that molten salts with lower z and higher n may be preferred and lower temperature lowers the $W_{REV}$ requirement while higher temperature reduces $W_{IRR}$.

The following example is set forth to specifically exemplify the invention and should not be considered as limiting the process.

EXAMPLE

An electrochemical cell as shown in the figure may be operated at atmospheric pressure and supplied cathode input gas having its principal composition by partial pressures:

0.15 atm. $O_2$
0.29 atm. $NO_2$
0.56 atm. $N_2$

This gas is passed in contact with the catalytic cathode surfaces where the cathode reaction as set forth in Equation I takes place. The cathode compartment exhaust gas has the principal composition:

0.07 atm. $O_2$
0.13 atm. $NO_2$
0.80 atm. $N_2$

This provides an average active gas composition of 0.011 atm. $O_2$ and 0.21 atm. $NO_2$ at the cathode surface. The electrolyte is maintained at a temperature of 540° C., at which temperature the alkali metal nitrates are molten. The potential required for the electrochemical reactions is 30 mV, the IR drop across the electrolyte is 50 mV, and the electrode polarization is 200 mV, or a total potential of 280 mV for a current density of 160 mA/cm². Operation of the electrochemical cell electrodes at 160 mA/cm² with a cell voltage of 0.280 volts results in a power requirement of 230 KWH/Ton (metric) $O_2$. This compares favorably with prior chemical $O_2$ separation processes. Due to the anode reaction as set forth in Equation II above, the gas concentration in the anode chamber and product gas output means is constant at 0.33 atm. $O_2$ and 0.67 atm. $NO_2$. Due to the high boiling point of $NO_2$ as compared to $O_2$, these two components may be easily separated and very pure $O_2$ withdrawn from the process.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. An electrochemical oxygen concentration cell comprising: spaced porous electrodes each in contact with an electrolyte on one side and a gas chamber on the other side, said electrolyte comprising oxygen containing molten inorganic salt retained in a porous matrix between two said spaced porous electrodes.

2. An electrochemical oxygen concentration cell according to claim 1 wherein said electrolyte has an oxygen containing portion selected from the group consisting of nitrate, carbonate, sulfate, and phosphate.

3. An electrochemical oxygen concentration cell according to claim 2 wherein said electrolyte has an alkali metal portion selected from the group consisting of potassium, sodium, lithium, and mixtures thereof.

4. An electrochemical oxygen concentration cell according to claim 1 wherein said electrolyte is retained in a porous matrix selected from the group consisting of MgO, $Al_2O_3$, $LiAlO_2$ and mixtures thereof.

5. An electrochemical oxygen concentration cell according to claim 1 wherein said electrodes comprise a catalyst selected from elements of the Periodic Table appearing in a group selected from the group consisting of Groups IB, IIB, IIIA, VB, VIB, VIIB and VIII in metal oxide or cermet form.

6. An electrochemical oxygen concentration cell according to claim 1 wherein said electrodes comprise a catalyst selected from the group consisting of zinc, silver, nickel, aluminum, iron, copper, chromium and mixtures thereof.

7. An electrochemical oxygen concentration cell according to claim 1 wherein one of said electrodes comprises copper oxide.

* * * * *